United States Patent [19]

Anderson

[11] Patent Number: 4,678,083

[45] Date of Patent: Jul. 7, 1987

[54] INTRUSION INDICATING SHIELD FOR CONSUMER PRODUCTS

[76] Inventor: David H. Anderson, 13002 Breezeway, Houston, Tex. 77037

[21] Appl. No.: 891,454

[22] Filed: Jul. 29, 1986

[51] Int. Cl.[4] ..... B65D 41/32

[52] U.S. Cl. ..... 206/459; 206/634; 206/807; 215/12 R; 215/230; 215/253

[58] Field of Search ..... 206/459, 634, 807, 534; 215/12 R, 230, 251, 252, 253, 256

[56] References Cited

U.S. PATENT DOCUMENTS

| | | | |
|---|---|---|---|
| 3,809,217 | 5/1974 | Harrison | 206/459 |
| 3,811,591 | 5/1974 | Novitch | 206/251 |
| 3,854,581 | 12/1974 | Jones, Jr. | 206/459 |
| 3,979,003 | 9/1976 | Allen | 215/256 |
| 4,197,947 | 4/1980 | Zaidi | 206/459 |
| 4,426,004 | 1/1984 | Hoag | 206/807 |
| 4,436,213 | 3/1984 | Paul, Jr. et al. | 206/807 |
| 4,540,101 | 9/1985 | Kutcher | 215/252 |
| 4,546,881 | 10/1985 | Tasma | 206/459 |

*Primary Examiner*—William Price
*Assistant Examiner*—Jimmy G. Foster
*Attorney, Agent, or Firm*—Fulbright & Jaworski

[57] ABSTRACT

A body fused together enclosing a container in which the body has at least one elongate perforation on the inside of the body extending outwardly from the interior of the body towards but spaced from the exterior of the body. A gripping surface on the exterior of the body for manually breaking the body along the perforations for providing access to the container. The body is of a semi-rigid plastic material that discolors when damaged for providing a visual indication of tampering.

9 Claims, 8 Drawing Figures

INTRUSION INDICATING SHIELD FOR CONSUMER PRODUCTS

BACKGROUND OF THE INVENTION

Recently there has been a rash of tampering episodes in which various consumer products have been opened and poison substances inserted therein causing deaths and great economic losses in recalling various products. At the present time the existing containers for most consumer products may be easily opened and reclosed without providing any evidence of tampering.

The present invention is directed to a packaging shield for replacing current paper boxes and/or cellophane packaging which can be easily removed by the consumer to provide access to the consumer container but which makes the introduction of foreign material into the consumer product container extremely difficult, and provides visual indications that the shield has been tampered with or damaged.

SUMMARY

The present invention is directed to an intrusion indicating shield for consumer products in a container having an opening which includes a body enclosing at least the opening to the container. The body includes at least one elongate perforation on the inside of the body extending outwardly from the interior of the body towards but spaced from the exterior of the body. Gripping means are provided on the exterior of the body for manually breaking the body along the perforations for providing access to the container. The body is a semi-rigid plastic material which discolors when damaged for providing a visual indication of tampering. In one form of the invention the material may be crystal styrene with butadiene rubber.

A still further object of the present invention is wherein the body includes first and second portions enclosing the entire container and each of the portions includes external gripping means and the portions are fused together.

Still a further object of the present invention is wherein the body includes a plurality of spaced elongate perforations positioned adjacent the middle of the body.

Yet a still further object of the present invention is wherein the portions of the body are partially conically shaped for stacking one inside of the other for ease of transportation.

Still a further object of the present invention is the provision of an intrusion indicating shield for consumer products in a container including a body fused closed and enclosing the container. The body includes a plurality of perforations on the inside of the body extending outwardly from the interior of the body towards but not to the exterior of the body and the perforations are located adjacent the middle of the body. Gripping means are provided on the exterior of the body adjacent each end for manually breaking the body along the perforations and the body is of a fusible semi-rigid clear plastic which discolors when damaged for providing a visual indication of tamering.

Still a further object of the present invention is wherein the perforations include a plurality of spaced longitudinally angled straight lines around the interior circumference of the body and a circular line around the inner circumference of the body which is connected to one end of the straight lines.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

At the present time various types of consumer products such as non-prescription medicines, vitamins, candies, toothpaste, foods, and even drinks may be opened, adulterated and closed without leaving any visual signs of such tampering.

Figure 1:
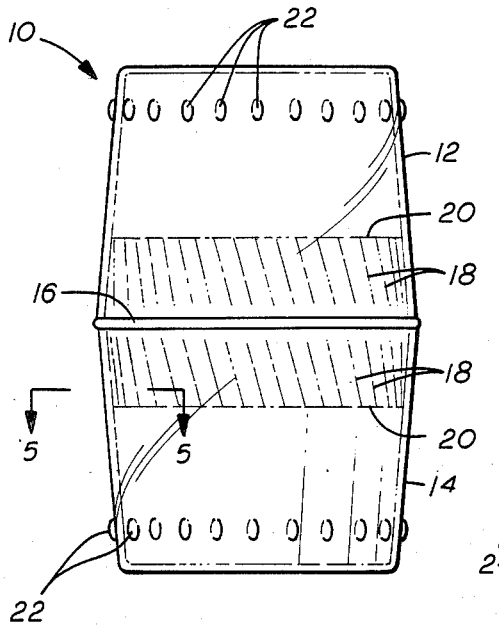
FIG. 1 is an elevational view of one embodiment of the present invention.

Referring now to the drawings, and particularly to FIG. 1, the reference numeral 10 generally indicates the intrusion indicating shield of the present invention which is a body which includes a first portion 12 and a second portion 14. The portions 12 and 14 are initially separate for allowing a consumer product container to be inserted therein. Thereafter, the portions 12 and 14 are joined together such as by a fusing seam 16 which may be made by chemical, electrical, or ultrasonic fusing to provide a shield or protector around the consumer container which can only be opened by destroying the shield 10. The shield 10 not only protects the product container from tampering but serves as a container for shipping, storage and display of the product.

However, after the product is purchased by a consumer, the shield 10 should be easily removable by the consumer for removal of the product container therein.

Figure 5:
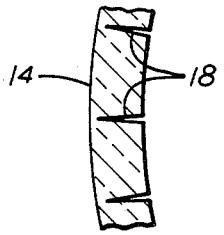
FIG. 5 is an enlarged cross-sectional view taken along the line 5—5 of FIG. 1.

The shield 10 includes at least one elongate perforation on the inside of the body extending outwardly from the interior of the body towards but spaced from the exterior of the body which will allow the shield to be easily opened. Preferably, the perforations include a plurality of spaced longitudinally angled straight lines 18, as best seen in FIGS. 1 and 5, which are positioned around the inner circumference of the body and may also include a circular perforation 20 around the inner circumference of the body which is connected to one end of the lines 18. Gripping means are provided on the exterior of the body such as protrusions 22 at each end of the body. A consumer may manually break the body along the perforations 18 and 20 by gripping the protrusions 22, twisting the portions 12 and 14 in opposite directions thereby breaking the shield 10 open for access to the container therein. Therefore, the shield 10 must be broken in order to handle the product container and once broken it cannot be put back together and thereby provides a visual indication of whether the shield has been possibly tampered with or broken.

In order to provide a highly visible sign of possible tampering, the body 10 is made of a semi-rigid plastic material which discolors when opened, heated, punctured or otherwise damaged. The material may be of any suitable material which discolors when stressed, such as K-resin sold by Phillips which is a crystal styrene with butadiene rubber. Another suitable material is a clear ABS with butadiene rubber content. These materials are normally clear, but when overstressed, damaged, or punctured turn milky color which would be visible to the user and would be an indication that the product was possibly contaminated. Nevertheless these materials provide sufficient strength for storage and transportation of product containers. As the perforations 18 and 20 are on the inside of the body and do not extend to the exterior surface of the body, the exterior surface is smooth and clear and therefore any damage or discoloration would be clearly visible to the user.

While the body may be made of any suitable shape for enclosing various shapes of product containers, it is advantageous for the body sections 12 and 14 to be made of tapered or partially conical sections as shown, in FIG. 1, whereby the sections 12 and 14 may be stacked one inside of the other for ease of transportation prior to enclosing a product container. This allows economy of packaging of the shield parts for transportation to the product assembly location. In addition, the portions 12 and 14 are identical thereby simplifying manufacture.

Figure 3:
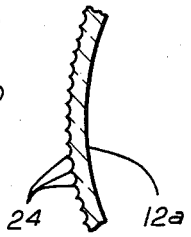
FIG. 3 is an enlarged cross-sectional view taken along the line 3—3 of FIG. 2.
Figure 2:
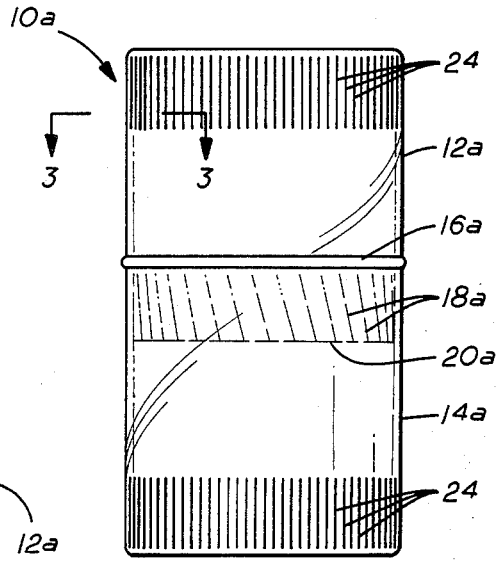
FIG. 2 is an elevational view of another embodiment of the present invention.

Other and various embodiments may be provided as will be more fully discussed hereinafter where like parts to those shown in FIGS. 1 and 5 are similarly numbered with the addition of the suffix "a". Thus, referring to FIGS. 2 and 3 a shield 10*a* is shown. The shield 10*a* is shown as being a cylinder. In addition, the gripping means 24 at either end of the body are in the form of ribs 24 for ease of gripping. Also the perforations 18*a* are positioned in only one of the body portions.

Figure 4:
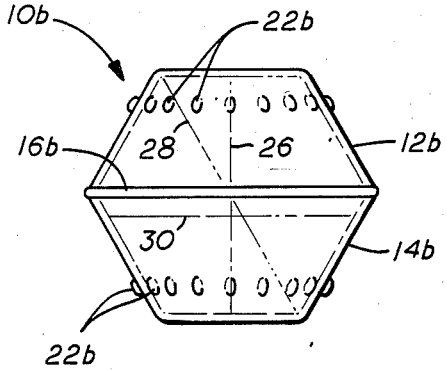
FIG. 4 is an elevational view of still a further embodiment of the present invention.

Referring now to FIG. 4, a shield container 10*b* is shown having portions 12*b* and 14*b* which again include a more exaggerated conical section which are fused together at a seam 16*b*. However, the internal perforations may merely be one or more lines 26, 28 or 30.

Figure 6:
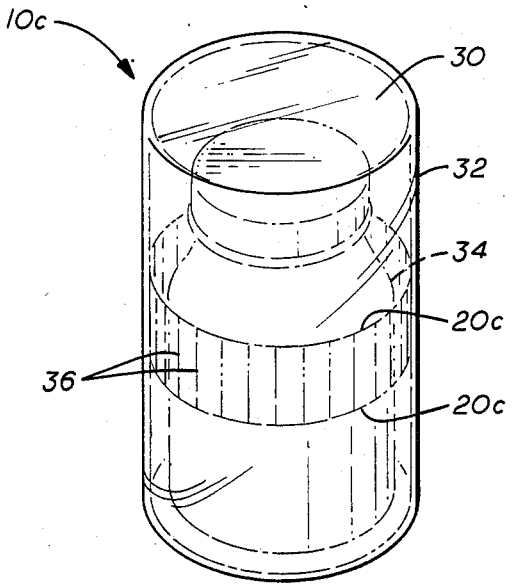
FIG. 6 is an elevational perspective view of another embodiment of the present invention enclosing a consumer product container.

Referring now to FIG. 6, a further embodiment of a shield 10*c* is best seen. In this case the shield 10*c* may be cylindrical in which the top 30 is fused to the body 32 to enclose the product container 34 therein. Two circular lines 20*c* are included in the perforations interconnecting with a plurality of spaced longitudinally straight perforation lines 36, which in this case are not angled but are longitudinally extending.

Figure 7:
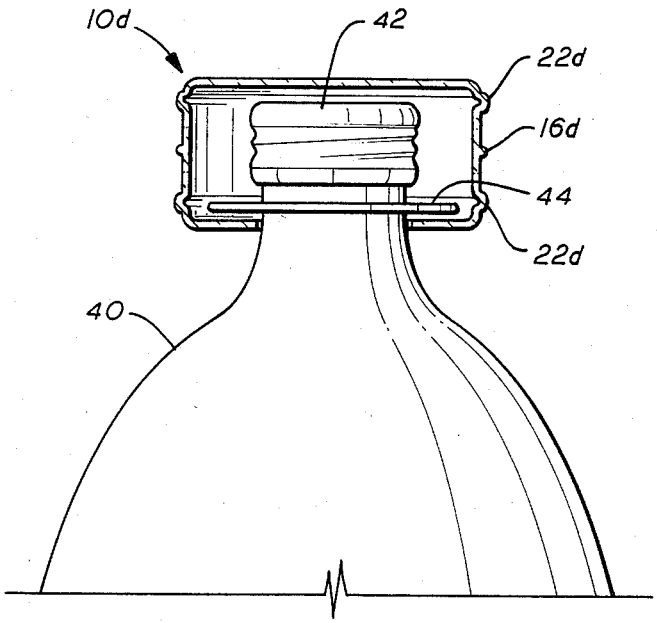
FIG. 7 is an electrical cross-sectional view of an embodiment enclosing only the opening of a product container.
Figure 8:
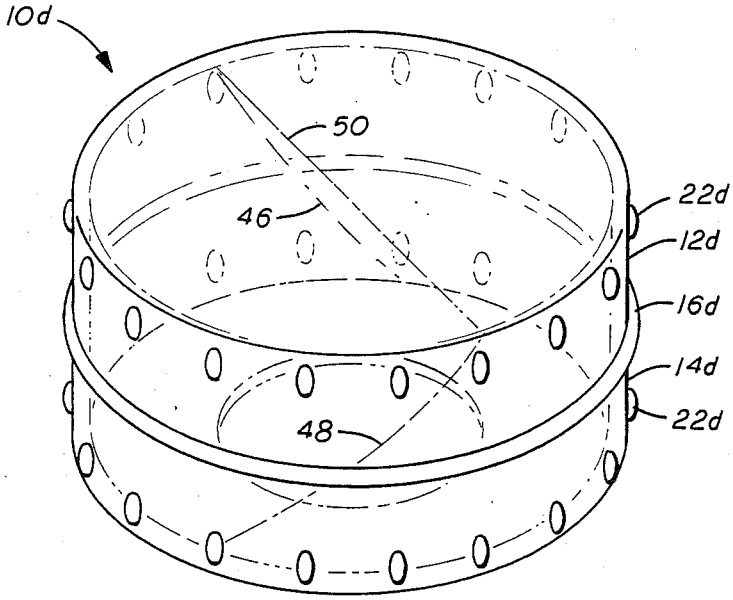
FIG. 8 is an electrical perspective of the embodiment shown in FIG. 7.

Referring now to FIGS. 7 and 8, the present invention is shown as only enclosing the opening of a product container, here shown as a conventional soft drink bottle 40 having a cap 42 manually sealing the opening of the bottle 40 and having a ridge 44. The shield 10*d* includes portions 12*d* and 14*d* enclosing the cap 42 and held on to the bottle 40 by the ridge 44. Each of the portions 12*d* and 14*d* include gripping means 22*d* and the portions 12*d* and 14*d* are fused together at 16*d*. The perforation may be spiral lines 46 and 48 and line 50 in top of the shield 10*d*.

Therefore, it is apparent that various types of protective shields may be utilized with various shapes, with various internal perforations for securely protecting a consumer product container from tampering as well as providing a sturdy shipping, storage and display container. However, once the shield is broken, penetrated or damaged, the ensuing stress will discolor the shield thereby providing a visual indication of possible tampering.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. An intrusion indicating shield for consumer products in a container having an opening comprising, a body enclosing the opening to the container, said body having at least one elongate perforation on the inside of the body extending outwardly from the interior of the body towards but spaced from the exterior of the body, gripping means on the exterior of the body for manually breaking the body along the perforations for providing access to the container, said body being of a semi-rigid plastic material which discolors when damaged for providing a visual indication of tampering.

2. The apparatus of claim 1 wherein said material is crystal styrene with butadiene rubber.

3. The apparatus of claim 1 wherein the body includes first and second portions enclosing the entire container, each of said portions having external gripping means, and said portions being fused together.

4. The apparatus of claim 1 wherein the body includes a plurality of spaced elongate perforations positioned adjacent the middle of the body.

5. The apparatus of claim 3 wherein the portions are partially conically shaped for stacking one inside of the other for transportation.

6. An intrusion indicating shield for consumer products in a container comprising, a body fused closed and enclosing the container, said body having a plurality of perforations on the inside of the body extending outwardly from the interior of the body towards but not to the exterior of the body, said perforations being adjacent the middle of the body, gripping means on the exterior of the body adjacent each end for manually breaking the body along the perforations for providing access to the container, and said body being of a fusible semi-rigid plastic which discolors when damaged for providing a visual indication of tampering.

7. The apparatus of claim 6 wherein said material is crystal styrene with butadiene rubber.

8. The apparatus of claim 6 wherein the perforations include, a plurality of spaced longitudinally straight lines around the inner circumference of the body, and a circular line around the inner circumference of the body which is connected to one end of the straight lines.

9. The apparatus of claim 6 wherein said material is ABS with butadiene rubber.

* * * * *